US005643532A

United States Patent [19]

Ito

[11] Patent Number: 5,643,532

[45] Date of Patent: Jul. 1, 1997

[54] CORROSION-RESISTANT SPRING STEEL

[75] Inventor: Yukio Ito, Yokkaichi, Japan

[73] Assignee: Daido Tokushuko Kabushiki Kaisha, Aichi-ken, Japan

[21] Appl. No.: 536,246

[22] Filed: Sep. 29, 1995

[30] Foreign Application Priority Data

Oct. 3, 1994 [JP] Japan ..... 6-239251
Aug. 21, 1995 [JP] Japan ..... 7-212239

[51] Int. Cl.[6] ..... C22C 38/42
[52] U.S. Cl. ..... 420/84; 420/112; 148/908
[58] Field of Search ..... 420/84, 112; 148/908

[56] References Cited

U.S. PATENT DOCUMENTS 5,286,312 2/1994 Shimotsusa et al. ..... 148/908
5,508,002 4/1996 Kawaguchi et al. ..... 148/908

OTHER PUBLICATIONS

Key to Steels, 10 Edition 1974 Germany.

*Primary Examiner*—Deborah Yee
*Attorney, Agent, or Firm*—Armstrong, Westerman, Hattori, McLeland, & Naughton

[57] ABSTRACT

A spring steel of medium strength and sufficient corrosion resistance prepared by simple procedures, and therefore, at a low cost, is provided. The spring steel has the alloy composition of: C 0.3–0.6%, Si 1.0–2.0%, Mn 0.1% to less than 0.5%, Cr 0.4–1.0%, V 0.1–0.3%, Ni more than 0.5% to 1.2%, Cu 0.1–0.3% and the balance of Fe, wherein S being at highest 0.005%, and [O], at highest 0.0015%. Addition of Ca 0.001–0.005% is preferable. In order to ensure clearly improved fatigue limit under corrosive environment to the conventional steel, SUP7, specific contents of S, Ni, Cr, Cu and V are chosen in the range set forth above. For the purpose of obtaining such a low hardness after normalizing at which annealing prior to processing is unnecessary contents of C, Si, Mn, Cr and Ni are further chosen in the above ranges.

4 Claims, 3 Drawing Sheets

CORROSION-RESISTANT SPRING STEEL

BACKGROUND OF THE INVENTION

The present invention concerns a spring steel of medium strength having good corrosion-resistance. The steel of the invention is particularly suitable for material of automobile suspension system.

In order to meet the demand for light-weighting of automobiles, it is necessary to light-weight springs of suspension systems of the automobiles, and therefore, there is demand for a spring steel having high resistance to permanent set in fatigue. There has been proposed so-called "high-silicon spring steel" prepared by adding to a spring steel which contains as main alloying elements, C: 0.35–0.45%, Si: 1.50–2.50% and Mn: 0.50–1.50% with the balance of Fe, at least one of V, Nb and Mo in a suitable amount or amounts to form a carbide or carbides (Japanese Patent Disclosure No. 58-67847). This steel may further contain one or both of the elements of two groups: one or more of Ti, Al and Zn in a suitable amount or amounts; and one or more of B, Cr, Ni and REM in a suitable amount or amounts.

The applicant has developed and proposed high strength spring steels (Japanese Patent Disclosures Nos. 63-109144 and 63-216951). These steel are also of high-Si content (1.0–4.0%) and contains Cr: 0.1–2.0% and Ni: up to 2.0% in addition to C: 0.3–0.75% and Si:1.0–4.0%, and characterized in that occurence of retained austenite after quenching is less than 10%. In order to keep the retained austenite occurence less than 10%, contents of C, Si and Ni are chosen to such amounts that satisfy the inequality: $35 \cdot C\ \% + 2 \cdot Si\ \% + Ni\ \% < 23\%$. This steel may further contain suitable amounts of V and/or Mo.

Separate to these steels, the applicant also developed a spring steel having high corrosion-resistance and corrosion-fatigue strength, and disclosed it (Japanese Patent Disclosure No. 02-301541). The steel exhibits high corrosion-resistance by forming direct oxide layers of thickness of 20 micrometers or thicker on the surface of the spring products. Due to the alloy composition of this steel similar to those of stainless steels, i.e., contents of Cr: 3–5% and Ni: 1–2%, costs of the steel products are somewhat high. Further, processability in the secondary processing of this steel is not so good.

A spring steel of such a high tensile strength as 200 kgf/mm$^2$ was proposed (Japanese Patent Disclosure No. 05-320826). This high tensile strength is achieved by adjusting hardness after quenching-tempering to HRC 53 or higher.

The high strength spring steel first mentioned in this description of the invention which was developed by the applicant is designed to have such a relatively high stress such as 130 kgf/mm$^2$. To produce wire rods for springs from this steel, it is necessary to go through the steps of: rolling—spheroidizing annealing—wire drawing—grinder abrasion. Because of relatively high alloying composition and necessity of heat treatment, costs for producing wire rods from this spring steel are considerably high in comparison with those for producing the conventional spring steel rods. Thus, there has been demand for a spring steel designed to have a strength level of 120 kgf/mm$^2$ with a lower alloying composition and simplified process for producing wire materials, and consequently, of lowered costs. This spring steel, which is used mainly for automobile suspension systems, should have, in addition to high resistance to permanent set in fatigue, excellent fatigue properties under corrosive environments. It is preferable that the steel can easily be processed in secondary processing steps, more specifically, that hardness as rolled is low.

SUMMARY OF THE INVENTION

The object of the present invention is to meet the above noted demand by providing a spring steel which has medium strength and is processable in simple wire producing process and therefore, with lowered production costs, and the corrosion-resistance is maintained to such level as substantially equal to those of high alloyed steels, particularly, suitable as a material for automobile suspension systems. The object of the invention encompasses improving fatigue properties under corrosive environments and reduced hardness as rolled for easier secondary processing.

The corrosion-resistant spring steel of this invention has an alloy composition consisting of, by weight, C: 0.3 to 0.6%, Si: 1.0 to 2.0%, Mn: 0.1% to less than 0.5%, Cr: 0.4 to 1.0%, V: 0.1 to 0.3%, Ni: more than 0.5% to 1.2%, Cu: 0.1 to 0.3% and the balance of Fe, wherein S being at highest 0.005% and O, at highest 0.0015%.

Preferably, the spring steel may further contain, in addition to the alloy composition defined above, Ca: 0.001 to 0.005%.

If it is desired to further improve the fatigue strength of this spring steel, it is preferable to choose the value calculated by formula (I) defined below at 1.10 or higher:

$$0.449-10.839(S\ \%)+0.249(Ni\ \%)+0.295(Cr\ \%)+0.878(Cu\ \%)+0.843(V\ \%) \quad \text{I}$$

This will ensure 10% improvement in fatigue limit under corrosive environments.

In case where higher processability is desired, it is recommended to choose the value calculated by formula (II) defined below at 108 or lower:

$$45.234+39.227(C\ \%)+7.784(Si\ \%)+24.267(Mn\ \%)+16.821(Cr\ \%)+11.799(Ni\ \%) \quad \text{II}$$

This will ensure that hardness after normalization of the present corrosion-resistant spring steel is HRB 108 or less, which is a substitute property of the hardness as rolled.

DETAILED EXPLANATION OF THE PREFERRED EMBODIMENTS

Figure 1:
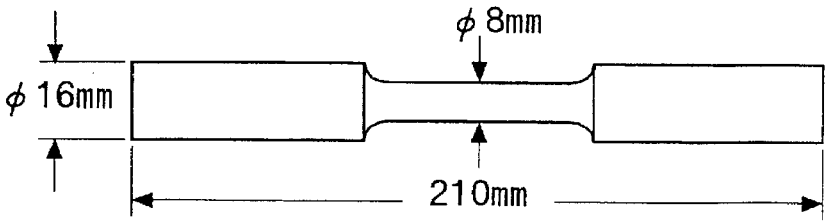
FIG. 1 is a figure illustrating the shape and the size of the test piece for rolling fatigue test in the working examples of the present invention.

The above defined alloy composition of the present steel is the conclusion of our research aiming at ensuring a designed stress of 120 kgf/mm$^2$ (hardness HRC 53–54), which is higher than that of the conventional steel, SUP7 (designed stress 100 kgf/mm$^2$, hardness HRC 48–49) and lower than the above mentioned high strength spring steel (designed stress 120 kgf/mm$^2$, hardness HRC 54–55), eliminating necessity of the steps of spheroidal annealing and grinder abrasion in the producing procedure. The reasons for limiting the ranges of the alloy components are as follows:

C: 0.3–0.6%

To maintain required strength of the steel at least 0.3% of carbon is necessary. On the other hand, a carbon content exceeding 0.6% lowers stiffness after quenching-tempering to such extent that will not satisfy fatigue strength required for a spring steel.

Si: 1.0–2.0%

For the purpose of obtaining effect of Si-addition by its dissolution into the ferrite matrix to increase resistance to permanent setting, 1.0% or more of silicon is necessary. On the other hand, addition exceeding 2.0% will result in formation of thicker decarburized layers at hot processing.

Mn: more than 0.1% and less than 0.5%

Manganese is necessary as a deoxidizing agent of the steel, and also for maintaining the strength. Addition of at least 0.1% is required. Manganese fixes sulfur by forming MnS. Our research revealed the fact that MnS particles are elongated by rolling, and the elongated MnS particles are oxidized to form pits under corrosive environment, which will be starting points of cracking, resulting in lowering of the fatigue strength. In order to decrease formation of MnS, Mn-content in the present steel is decided to be low with the upper limit less than 0.5%.

Cr: 0.4–1.0%

To ensure quenchability 0.4% or more of chromium is added. Too much addition will impair uniformity in the structure of the steel and will decrease resistance to permanent setting, and therefore, addition must be up to 1.0%.

V: 0.1–0.3%

Vanadium forms fine carbide particles and thus makes the structure of the steel fine. This effect is favorable for improving resistance to permanent setting. The effect will be appreciable at a content of 0.1% or higher. A much higher content increases deposition of carbide particles, which deteriorate stiffness as well as resistance to permanent setting. The above upper limit, 0.3% was thus determined.

Ni: more than 0.5% up to 1.2%

Nickel is added in an amount exceeding 0.5% to improve quenchability and stiffness. This effect is remarkable at a content around 1.0%, and addition of more than 1.2% no longer increases the effect.

Cu: 0.1–0.3%

It is known that copper is useful to improve atmospheric corrosion resistance, and also in the present spring steel copper improves resistance to corrosion. To obtain this effect, at least 0.1% addition is required. Addition exceeding 0.3% is harmful to hot processability.

S: up to 0.005%, O : up to 0.0015%

It is reasonable to suppress sulfur content because of necessity for suppressing formation of MnS which are starting points of corroded pits. Also, O should be as low as possible from the view point of suppressing formation of oxide inclusions. As the maximum permissible limits, 0.005% for sulfur and 0.0015% for oxygen were respectively given.

The reasons for determining the content of calcium, which is an optionally added element, is as follows:

Ca: 0.001–0.005%

As described above, the amount of manganese is chosen to be low for the purpose of supressing formation of MnS. Then, fixing sulfur with other elements is necessary. Addition of calcium is effective for this purpose. Because the sulfur content is limited to 0.05%, addition of calcium in the above noted range, 0.001–0.005% being sufficient.

"Percentage of improving fatigue limit under a corrosive environment" is a parameter showing the extent of improvement in the fatigue limit of the present spring steel (with HRC 53–54) in comparison with the fatigue limit of the conventional spring steel, SUP7 (with HRC 48–49). Thus, in cases where ratios of the fatigue limits of the present steels to the fatigue limit of the the conventional steel, SUP7, are less than 1.0, the steels are inferior to SUP7; in cases where the ratios are equal to 1.0, the steels have the same performance with that of SUP7; and only in cases where the ratios exceed 1.0, desired improvement is achieved. For instance, if the ratio is 1.1, then 10% improvement is achieved. It should be noted that there is some difficulty in increasing the fatigue limit under corrosive environment of the present spring steel which has a higher hardness than that of the conventional steel. It is, however, our intension to achieve at least 10% improvement in this invention. We have established the alloy composition which surely fulfils our intention by regression analysis of the data from working examples. The result of this search is the above noted formula (I).

If hardness after rolling, which is a substitute of hardness as normalized, is high, then annealing will be necessary to facilitate subsequent secondary processing of the product steel, and if low, then the annealing is unnecessary. The hardness which decides necessity and unnecessity of the annealing is practically HRB 108, and thus it is advantageous to achieve a hardness as normalized not exceeding this limit. The hardness as normalized is of course influenced by the alloy composition. The relation between the alloy composition and the hardness as normalized is empirically expressed by the formula (II).

The designed strength of the present spring steel is not higher than 120 kgf/mm$^2$ due to the low-alloying composition in comparison with the high strength spring steel described above. However, in the present spring steel, though the hardness level as heat-refined is higher than that of the conventional spring steel, SUP7, the fatigue limit is improved 10% or more and the fatigue resistance under corrosive environment is enhanced. Because of the low alloying composition processing can be done by simple procedures, i.e., spheroidizing annealing after wire drawing which is necessary for the high strength spring steel can be eliminated and also, the grinder abrasion after wire drawing is unnecessary. Thus, the production costs for the spring will be much lower than those for the products from the high strength steel. Hardness after normalizing of the present steel can be so low as HRB 108 in the preferred embodiments and thus, annealing prior to the subsequent processing may be unnecessary.

The present invention makes it possible to produce springs having high corrosion resistance at the costs substantially the same as those for the conventional products and the performance of little difference from that of the high strength spring steel. Thus the present invention provides, when applied to the springs for automobile suspension system, relatively light-weight products having sufficient corrosion resistance.

EXAMPLES

Example 1

Three kinds of steels of the alloy composition shown in Table 1 (weight %, the balance being Fe) were prepared.

TABLE 1

| | C | Si | Mn | Cr | Ni | V | others | S | [O] |
|---|---|---|---|---|---|---|---|---|---|
| SUP7 | 0.60 | 1.95 | 0.85 | 0.15 | 0.1 | 0.01 | — | 0.015 | 0.0011 |
| Example | 0.45 | 1.6 | 0.20 | 0.85 | 1.0 | 0.2 | Cu 0.2 | 0.003 | 0.0010 |
| ND250S* | 0.40 | 2.5 | 0.41 | 0.85 | 1.8 | 0.2 | Mo 0.5 | | |

*high strength spring steel according to Japanese Patent Disclosure No. 63-109144

These steels were forged to prepare wire rods of diameter 17 mm. From these wire rods, test pieces of the shape and size shown in FIG. 1 were prepared by machining, and the test pieces were subjected to heat treatment so as to adjust hardness thereof to the following ranges:

| | |
|---|---|
| SUP7 | HRC 48–49 |
| present steel | HRC 53–54 |
| ND250S | HRC 54–55 |

Figure 2:
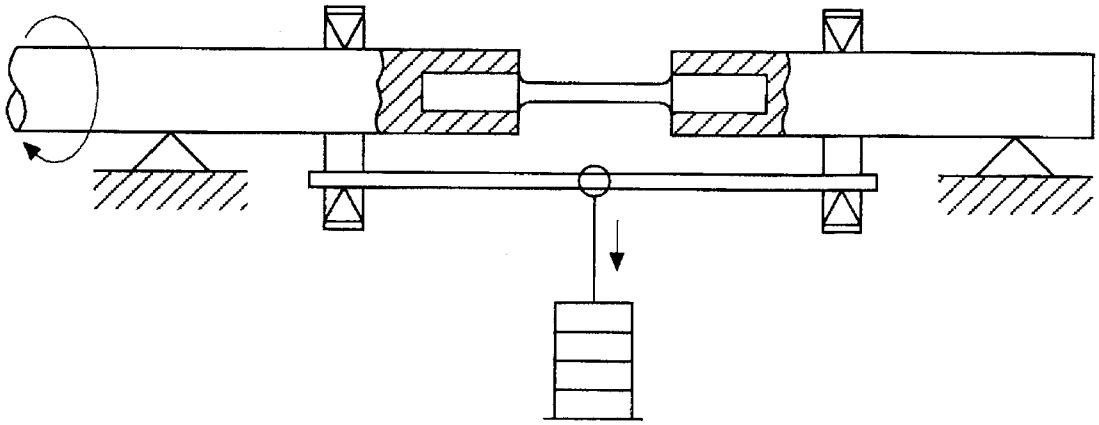
FIG. 2 is a figure illustrating the rolling fatigue test using the test piece shown in FIG. 1.
Figure 3:
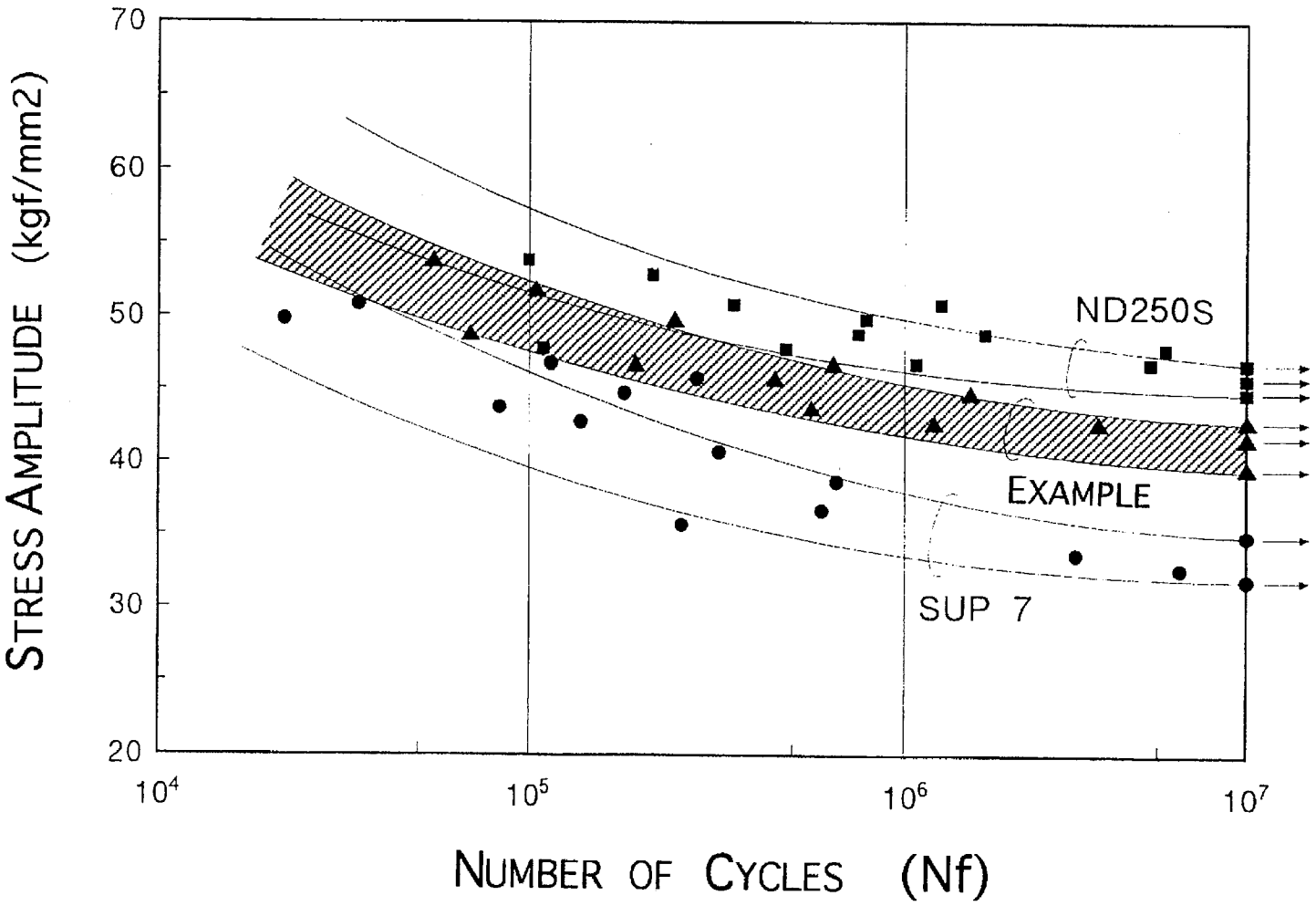
FIG. 3 is a graph showing the data of the working examples of the present invention, or the results of rolling fatigue tests after corrosion of the present spring steel in comparison with those of the conventional spring steel.

These test pieces were subjected to rolling fatigue test under bending after corrosion. The corrosion was carried out by 10-cycles of salt water spraying (8 hours)—exposure to atmosphere (16 hours). The rolling fatigue test was carried out in accordance with the method defined in JIS Z-2274 under the conditions where bending stress was applied to the test pieces as illustrated in FIG. 2. Relation between the number of repetitions of rolling bending stress and the magnitude of stress at breaking are shown in FIG. 3. From the graph of FIG. 3, it is understood that the spring steel of the invention exhibits better corrosion fatigue strength than that of the conventional steel and nearly equal performance as that of the high strength steel.

Example 2

The steels of the alloy compositions (weight %, the balance being Fe) were prepared. Subsequent forging as done in Example 1 gave wire rods of diameter 17 mm. From the wire rods, test pieces of the shape and size shown in FIG. 1 were made by machining, which were, after being heat treated to refine the hardness at HRC 53–54, subjected to rolling fatigue tests after being corroded. The conditions for corrosion were 10-cycle repeating of salt water spraying (8 hours)—exposure to the atmosphere of constant temperature and humidity (35° C., 60% RH; 16 hours). The rolling fatigue tests were carried out also in accordance with the method defined in JIS Z-2274.

As the fatigue limits of these steels, the values of time-strength at $10^7$ (MPa) were recorded in Table 2. Table 2 shows the ratios of these values to an averaged time-strength at $10^7$ (350 MPa) of SUP7, which is taken as the standard, (ratios of the fatigue limits) as well as the observed values of hardness after normalizing (hardness as rolled).

The results in Table 2 show that the fatigue limits under corrosive environment of the spring steel are improved 10% or more, in some cases, 30% or more, and that, in preferable embodiments, the hardness after normalizing (or the hardness as rolled) may be lowered to HRB 108 or less, which eliminates, necessity of annealing prior to processing.

Figure 4:
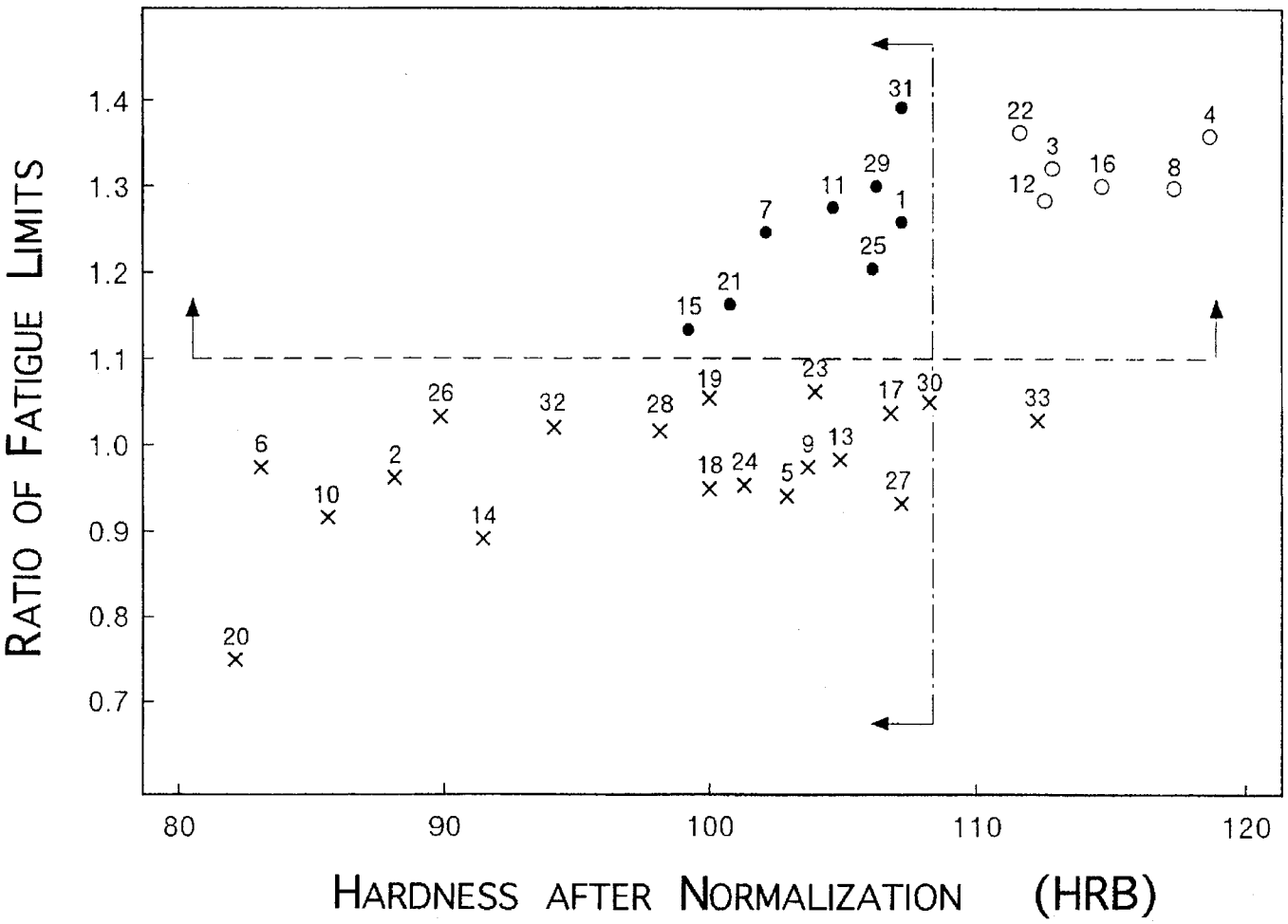
FIG. 4 is a graph showing the working examples made by plotting the data of the present steel, in which the hardness after normalizing is in the axis of abscissas and the ratios of the fatigue limits in the axis of ordinates.

FIG. 4 is a graph made by plotting the hardness after normalizing in the axis of abscissas and the improvement of the fatigue limits (ratios of the fatigue limits of the present steel to the fatigue limit of SUP7) in the axis of ordinates. In FIG. 4, numerical numbers suffixed to the plots are the sample numbers in Example 2. Samples plotted in the domain above the horizontal broken line are preferable ones in which the improvement in the fatigue limits is 10% or more; and the samples in the domain leftside the vertical dashed line are preferable ones in which the values of hardness after normalizing are HRB 108 or lower. In FIG. 4 patterns of the plots bear the following meaning:

very preferable, examples having 10% or more improvement in fatigue limit and the hardness after normalizing HRB 108 or less, O examples of 10% or more improvement in fatigue limit, and X control examples.

TABLE 2

| | Alloy Composition | | | | | | | | | Hardness after Normalizing | Fatigue Limit | Ratio of Fatigue |
|---|---|---|---|---|---|---|---|---|---|---|---|---|
| No. | C | Si | Mn | Cr | V | Ni | Cu | S | (O) | (HRB) | (MPa) | Limits |
| 1 | 0.46 | 1.61 | 0.20 | 0.85 | 0.20 | 1.02 | 0.20 | 0.0040 | 0.0010 | 107 | 441 | 1.26 |
| 2 | 0.24 | 1.05 | 0.45 | 0.43 | 0.25 | 0.55 | 0.15 | 0.0040 | 0.0011 | 88 | 338 | 0.96 |
| 3 | 0.31 | 1.82 | 0.48 | 0.95 | 0.19 | 1.13 | 0.19 | 0.0030 | 0.0011 | 112 | 458 | 1.31 |
| 4 | 0.58 | 1.96 | 0.38 | 0.85 | 0.20 | 1.00 | 0.21 | 0.0040 | 0.0010 | 118 | 471 | 1.35 |
| 5 | 0.66 | 1.91 | 0.15 | 0.45 | 0.13 | 0.52 | 0.12 | 0.0050 | 0.0011 | 103 | 331 | 0.95 |
| 6 | 0.45 | 0.52 | 0.15 | 0.50 | 0.15 | 0.60 | 0.15 | 0.0040 | 0.0012 | 85 | 323 | 0.92 |
| 7 | 0.44 | 1.03 | 0.21 | 0.86 | 0.20 | 0.99 | 0.19 | 0.0030 | 0.0011 | 102 | 432 | 1.24 |
| 8 | 0.57 | 2.01 | 0.45 | 0.66 | 0.20 | 1.00 | 0.20 | 0.0040 | 0.0010 | 117 | 452 | 1.29 |
| 9 | 0.55 | 2.52 | 0.13 | 0.50 | 0.15 | 0.53 | 0.15 | 0.0050 | 0.0011 | 104 | 343 | 0.98 |
| 10 | 0.35 | 1.21 | 0.05 | 0.43 | 0.18 | 0.53 | 0.26 | 0.0040 | 0.0012 | 83 | 340 | 0.97 |
| 11 | 0.45 | 1.62 | 0.11 | 0.85 | 0.21 | 1.02 | 0.20 | 0.0020 | 0.0011 | 104 | 445 | 1.27 |
| 12 | 0.44 | 1.60 | 0.46 | 0.84 | 0.20 | 1.01 | 0.19 | 0.0040 | 0.0010 | 112 | 448 | 1.28 |
| 13 | 0.56 | 1.04 | 0.67 | 0.43 | 0.12 | 0.53 | 0.12 | 0.0030 | 0.0011 | 104 | 345 | 0.99 |
| 14 | 0.53 | 1.05 | 0.14 | 0.36 | 0.12 | 0.71 | 0.12 | 0.0040 | 0.0012 | 91 | 315 | 0.90 |
| 15 | 0.44 | 1.61 | 0.20 | 0.41 | 0.21 | 1.01 | 0.20 | 0.0040 | 0.0011 | 99 | 395 | 1.13 |
| 16 | 0.50 | 1.89 | 0.48 | 0.62 | 0.27 | 1.01 | 0.19 | 0.0050 | 0.0012 | 114 | 454 | 1.30 |
| 17 | 0.52 | 1.92 | 0.12 | 1.09 | 0.11 | 0.50 | 0.10 | 0.0050 | 0.0011 | 107 | 365 | 1.04 |

TABLE 2-continued

| | Alloy Composition | | | | | | | | | Hardness after Normalizing | Fatigue Limit | Ratio of Fatigue |
|---|---|---|---|---|---|---|---|---|---|---|---|---|
| No. | C | Si | Mn | Cr | V | Ni | Cu | S | (O) | (HRB) | (MPa) | Limits |
| 18 | 0.35 | 1.12 | 0.48 | 0.93 | 0.04 | 0.55 | 0.12 | 0.0040 | 0.0010 | 100 | 334 | 0.96 |
| 19 | 0.57 | 1.88 | 0.14 | 0.42 | 0.33 | 0.51 | 0.11 | 0.0050 | 0.0011 | 100 | 371 | 1.06 |
| 20 | 0.36 | 1.32 | 0.15 | 0.43 | 0.12 | 0.21 | 0.13 | 0.0040 | 0.0012 | 82 | 263 | 0.75 |
| 21 | 0.44 | 1.60 | 0.21 | 0.85 | 0.21 | 0.52 | 0.20 | 0.0020 | 0.0011 | 100 | 405 | 1.16 |
| 22 | 0.46 | 1.74 | 0.39 | 0.86 | 0.32 | 0.81 | 0.21 | 0.0040 | 0.0013 | 111 | 474 | 1.36 |
| 23 | 0.30 | 1.43 | 0.48 | 0.41 | 0.10 | 1.53 | 0.11 | 0.0050 | 0.0014 | 104 | 374 | 1.07 |
| 24 | 0.32 | 1.25 | 0.49 | 0.96 | 0.12 | 0.52 | 0.05 | 0.0040 | 0.0013 | 101 | 335 | 0.96 |
| 25 | 0.44 | 1.60 | 0.20 | 0.85 | 0.21 | 1.00 | 0.11 | 0.0020 | 0.0011 | 106 | 419 | 1.20 |
| 26 | 0.31 | 1.20 | 0.42 | 0.43 | 0.11 | 0.53 | 0.36 | 0.0050 | 0.0015 | 90 | 364 | 1.04 |
| 27 | 0.45 | 1.59 | 0.22 | 0.85 | 0.21 | 1.02 | 0.21 | 0.0360 | 0.0011 | 107 | 325 | 0.93 |
| 28 | 0.36 | 1.61 | 0.21 | 0.84 | 0.20 | 0.56 | 0.22 | 0.0140 | 0.0012 | 98 | 356 | 1.02 |
| 29 | 0.44 | 1.61 | 0.20 | 0.85 | 0.20 | 1.00 | 0.21 | 0.0010 | 0.0010 | 106 | 451 | 1.29 |
| 30 | 0.45 | 1.60 | 0.21 | 0.86 | 0.19 | 0.99 | 0.20 | 0.0040 | 0.0025 | 108 | 370 | 1.06 |
| 31 | 0.45 | 1.62 | 0.20 | 0.85 | 0.21 | 1.01 | 0.19 | 0.0040 | 0.0011 | 107 | 487 | 1.46 |
| | | | | | | | | Ca | 0.003 | | | |
| 32 | 0.32 | 1.01 | 0.12 | 0.82 | 0.12 | 1.02 | 0.12 | 0.0050 | 0.0011 | 94 | 358 | 1.02 |
| 33 | 0.58 | 1.98 | 0.48 | 0.62 | 0.12 | 0.62 | 0.11 | 0.0050 | 0.0012 | 112 | 362 | 1.03 |

We claim:

1. A corrosion resistant spring steel having an alloy composition consisting of, by weight, C: 0.3 to 0.6%, Si: 1.0 to 2.0%, Mn: 0.1 to less than 0.5%, Cr: 0.4 to 1.0%, V: 0.1 to 0.3%, Ni: 1.01 to 1.2%, Cu: 0.1 to 0.3% and the balance of Fe, wherein S is not more than 0.0015%, and O is not more than 0.0015%.

2. A corrosion-resistant spring steel according to claim 1, which further contains, in addition to the alloy composition defined in claim 1, Ca: 0.001 to 0.005%.

3. A corrosion-resistant spring steel according to one of claims 1 and 2, wherein at least 10% improvement in fatigue limit under corrosive atmosphere is ensured by choosing the value calculated by formula (I) defined below at 1.10 or higher:

$$0.449-10.839(S\ \%)+0.249(Ni\ \%)+0.295(Cr\ \%)+0.878(Cu\ \%)+0.843(V\ \%) \quad \text{I.}$$

4. A corrosion-resistant spring steel according to one of claims 1 and 2, wherein hardness after normalization (HRB) at least 108 is ensured by choosing the value expressed by formula (I) defined below at 108 or lower:

$$45.234+39.227(C\ \%)+7.784(Si\ \%)+24.267(Mn\ \%)+16.821(Cr\ \%)+11.799(Ni\ \%) \quad \text{II.}$$

* * * * *